US008250705B2

(12) United States Patent
Oshima

(10) Patent No.: US 8,250,705 B2
(45) Date of Patent: Aug. 28, 2012

(54) HINGE CUP WITH POSITION ADJUSTMENT FUNCTION

(75) Inventor: Kazuyoshi Oshima, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 197 days.

(21) Appl. No.: 12/773,873

(22) Filed: May 5, 2010

(65) Prior Publication Data

US 2010/0281652 A1 Nov. 11, 2010

(30) Foreign Application Priority Data

May 11, 2009 (JP) ..... 2009-114980

(51) Int. Cl.
*E05D 7/04* (2006.01)

(52) U.S. Cl. ..... 16/236; 16/238; 16/382

(58) Field of Classification Search ..... 16/237, 16/238, 235, 236, 240, 242, 245, 246, 382
See application file for complete search history.

(56) References Cited

U.S. PATENT DOCUMENTS

| | | | | | |
|---|---|---|---|---|---|
| 4,185,357 | A * | 1/1980 | Busse | ..... | 16/265 |
| 4,434,523 | A * | 3/1984 | Grass | ..... | 16/242 |
| 5,245,727 | A * | 9/1993 | Sasaki | ..... | 16/258 |
| 6,643,895 | B1 * | 11/2003 | Domenig et al. | ..... | 16/238 |
| 7,017,231 | B2 * | 3/2006 | Isele | ..... | 16/242 |
| 7,117,561 | B1 * | 10/2006 | Domenig et al. | ..... | 16/236 |
| 7,480,962 | B2 * | 1/2009 | Takamatsu et al. | ..... | 16/382 |

FOREIGN PATENT DOCUMENTS

| | | | |
|---|---|---|---|
| DE | 2721951 | A * | 11/1978 |
| JP | 2007-321529 | A | 12/2007 |

* cited by examiner

*Primary Examiner* — Chuck Y. Mah
(74) *Attorney, Agent, or Firm* — Pearne & Gordon LLP

(57) ABSTRACT

A cup embedded type hinge device with position adjustment function comprising a position adjustment mechanism between a cup member and an arm member of a hinge body including a U-shaped position adjustment holder superposed on a recess of the cup member through a gap and a cam member provided between the position adjustment holder and the flange of the cup member to set the position of the cup member relative to the position adjustment holder and having a cam disk engaged into a circular hole in the position adjustment holder and an eccentric pin engaged into an elongated hole in the flange of the cup member whereby the position of the cup member is set by rotation of the cam disk.

5 Claims, 18 Drawing Sheets

(A)

(B)

(A)

(B)

(A)

(B)

HINGE CUP WITH POSITION ADJUSTMENT FUNCTION

FIELD OF THE INVENTION

This invention relates to a hinge device for mutually connecting two objects such as a case and a door of various containers with a door such as a playing tool or furniture in a openable/closable manner and more particularly, an improvement of a cup embedded type hinge device with position adjustment function adapted to connect a cup member attached to an inner face of a movable object such as a door and a hinge body attached to an inner wall face of a stationary object such as a case while the position between them is adjusted to each other.

BACKGROUND OF THE INVENTION

Generally, such a hinge device comprises a cup member attached to a door and a hinge body attached to the cup member through a foldable link member (or an arm member) and also attached to an inner wall face of a case of a container such as furniture with the link member embedded in the cup member in a door closed state.

In case where such a hinge device is to be attached to the case and the door of the container between them, it is required that the hinge body and the cup member should be connected so that the case to which the hinge body is attached and the door to which the cup member is attached are properly positioned to each other. The hinge device of prior art to meet the requirement is disclosed in JP2007-321529A.

In the prior art disclosed in this document, in order to connect the hinge body and the cup member to each other while the case and the door of the container is properly positioned, the hinge device has a position adjustment mechanism comprising a position adjustment holder (articulated joint 27) connected integrally with to the hinge body (main body 5) and superposed on the cup member so as to be able to adjust the position of the hinge body within a recess of the cup member (a cup part 6) through a gap and a cam (a cam 23) provided in an eccentric manner on a polygonal disk (a cam part 26) attached to the bottom of the cup member and engaging an elongated hole (an elongated hole 29) in the position adjustment holder and having an eccentric pin (an axial part 24) rotatably extending through the position adjustment holder (the articulated joint 27).

However, since such a cup embedded type hinge device with position adjustment function according to the prior art is provided within the recess of the cup member, the component (the cam 23 of JP2007-321529A) constituting the position adjustment mechanism has to be disposed so as not to protrude from the upper face of the position adjustment holder (the joint 27) superposed on the recess of the cup member whereby the cam 23 is avoided from interfering with the link member. Thus, the shape of the cam is limited and in addition thereto, in order that the door side is so designed as to adjust the position thereof in both of a forward/backward direction (a direction perpendicular to the open face of the container) and a leftward/rightward direction (a direction widthwise of the container), it disadvantageously becomes difficult to assemble it within the narrow space in the recess of the cup member. Although interference with the arm member may be avoidable by making the recess of the cup member deeper, this undesirably needs to enlarge the thickness of the cup member.

SUMMARY OF THE INVENTION

Accordingly, it is an object of the invention to provide a cup embedded type hinge device with position adjustment function which can be attached between two objects while adjusting a position of a movable object such as a door of a container relative to a stationary object such as a case of the container with high flexibility without making the recess of the cup member deeper and without limiting the shape of the cam.

In accordance with the present invention, there is provided a cup embedded type hinge device with position adjustment function comprising a cup member attached to one of two objects to be connected to each other in an openable/closable manner; an arm member pivotally supported on said cup member by a pivotal pin; a hinge body pivotally connected to said arm member and attached to the other object; and a position adjustment mechanism for adjusting the position of said cup member relative to said hinge body, said position adjustment mechanism including a U-shaped position adjustment holder superposed on a recess of said cup member so as to be able to adjust the position of said cup member within said recess through a gap and cup position setting means to set said U-shaped position adjustment holder and said cup member relatively in a predetermined position, and said pivotal pin extending through said U-shaped position adjustment holder whereby said cup member is held in said U-shaped position adjustment holder by properly setting the position of said cup member relative to said position adjustment holder, said hinge device is characterized in that said position adjustment mechanism has a flange provided on said cup member to secure said cup member to said one object and a mount piece provided on said U-shaped position adjustment holder and corresponding to said flange of said cup member and said cup position setting means is disposed between said flange of said cup member and said mount piece of said position adjustment holder.

In the aforementioned hinge device, said position adjustment mechanism may have a single U-shaped position adjustment holder whereby the position of said cup member is adjusted in one direction of position adjustment relative to said hinge body or may have two U-shaped position adjustment holders and two cup position setting means provided corresponding to said U-shaped position adjustment holders, respectively whereby the position of said cup member is adjusted relative to said hinge body in two position adjustment directions intersecting perpendicularly.

In the aforementioned hinge device, the cup position setting means may be provided with a cam member which can properly set the position of said cup member relative to said hinge body whereby said cup member can be held in said position adjustment holder in a predetermined position. In this case, a cam disk of said cam member may be in the form of being rotatably engaged in a circular hole formed in said mount piece of said U-shaped position adjustment holder and an eccentric pin of said cam member may be in the form of engaged in an elongated hole in said flange of said cup member.

In the aforementioned hinge device, in place of said cup position setting means provided with said cam member, said cup position setting means may be in the form of comprising a threaded hole formed in said flange of said cup member, an elongated hole formed in said mount piece of said position adjustment holder and a setscrew threadedly engaged into a threaded hole in said flange of said cup member through said elongated hole in said mount piece.

According to the present invention, since the position adjustment mechanism is disposed in a position facing the flange of the cup member, but not in the bottom of the cup member, the arm member folded up in the closed position of the container and embedded in the cup member never interferes with the cam member. Thus, the arm member can be positively embedded in the inside of the cup member without deepening the cup member and therefore, the shape of the cam member is never limited and can be designed in a flexible manner without any restrictions.

In addition thereto, since the position adjustment mechanism is provided not in the narrow space of the recess of the cup member, but corresponding to the flange outsides the recess, it can be easily assembled in larger space and therefore, the workability of assembling can be more improved.

BRIEF DESCRIPTION OF THE DRAWINGS

FIG. 5 illustrates sides of the cup embedded type hinge device with position adjustment function of FIG. 1 wherein FIG. 5(A) is a right side view thereof and FIG. 5(B) is a left side view thereof;

FIG. 6 illustrates a state where the cup embedded type hinge device with position adjustment function of FIG. 1 is half-cut wherein FIG. 6(A) is a perspective view of the left-hand side half and FIG. 6(B) is a perspective view of the right-hand side half;

FIG. 9 illustrates sequential position adjustment states of the cup embedded type hinge device with position adjustment function of FIG. 1 wherein FIG. 9(A) is a top view of the state where the cup member is set in the position of most left-hand side relative to the hinge body not shown, FIG. 9(B) is a top view of the state where the cup member is set in the middle position relative to the hinge body not shown and FIG. 9(C) is a top view of the state where the cup member is set in the position of most right-hand side relative to the hinge body not shown;

FIG. 15 illustrates the sides of the cup embedded type hinge device with position adjustment function of FIG. 11 wherein FIG. 15(A) is a right side view thereof and FIG. 15(B) is a left side view thereof;

FIG. 16 illustrates a state where the cup embedded type hinge device with position adjustment function of FIG. 11 is half-cut wherein FIG. 16(A) is a perspective view of the left-hand side half and FIG. 16(B) is a perspective view of the right-hand side half;

FIG. 19 illustrates sequential position adjustment states of the cup embedded type hinge device with position adjustment function of FIG. 11 wherein FIG. 19(A) is a top view of the state where the cup member is set in the position of most left-hand side relative to the hinge body not shown, FIG. 19(B) is a top view of the state where the cup member is set in the middle position relative to the hinge body not shown and FIG. 19(C) is a top view of the state where the cup member is set in the position of most right-hand side relative to the hinge body not shown, FIG. 19(D) is a top view of the state where the cup member is set in the position farthest relative to the hinge body not shown, FIG. 19(E) is a top view of the state where the cup member is set in the longitudinal middle position relative to the hinge body not shown and FIG. 19(F) is a top view of the state where the cup member is set in the position closet to the hinge body not shown;

FIG. 20 illustrates a cam member used for the first and second embodiments of the invention in an enlarged form wherein FIGS. 20(A) through 20(D) are a perspective view, a top view, a side view and a bottom view of the cam member, respectively;

DESCRIPTION OF PREFERRED EMBODIMENTS

Figure 1:
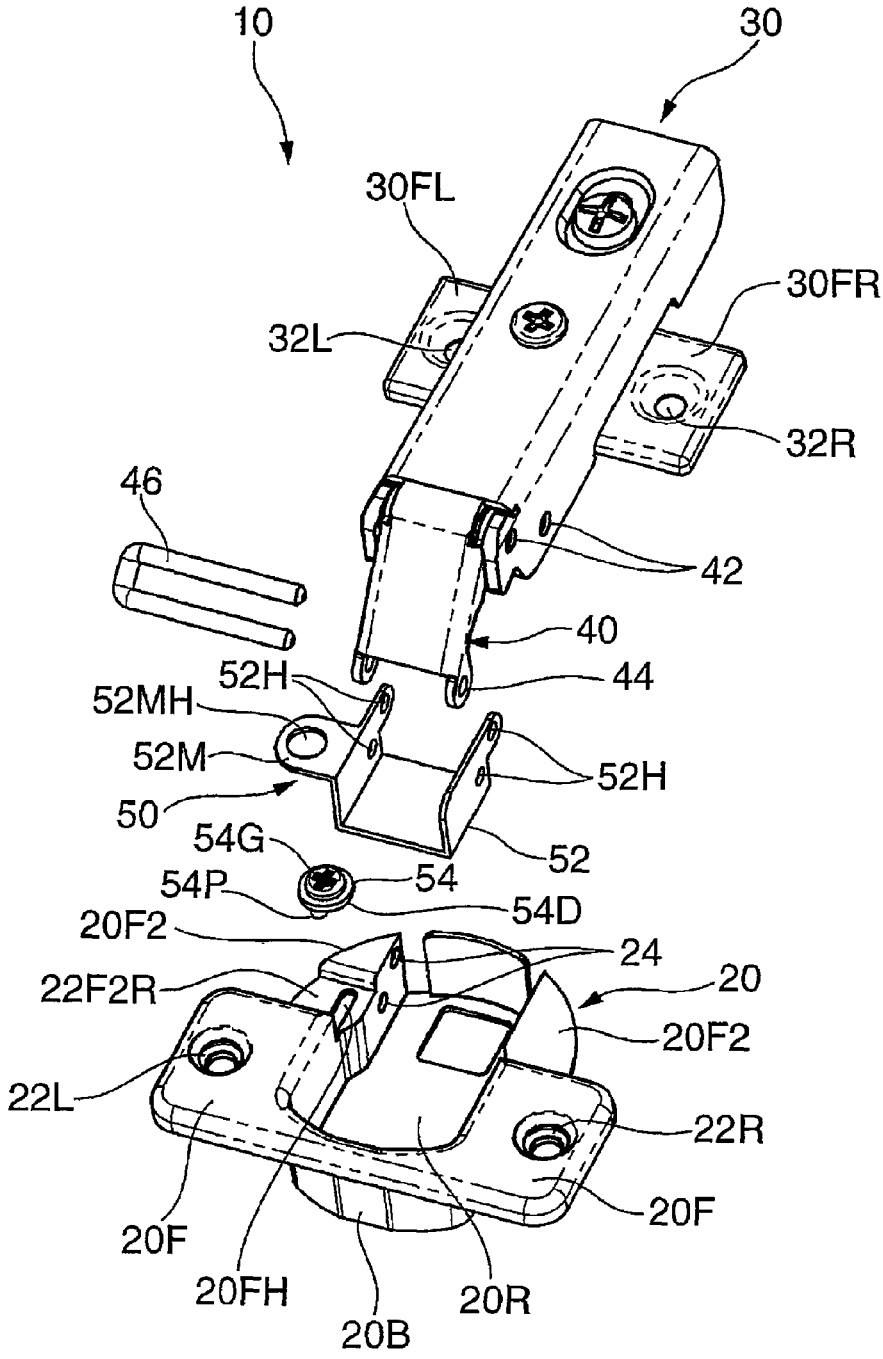
FIG. 1 is an exploded perspective view of a whole cup embedded type hinge device with position adjustment function according to a form of a first embodiment of the invention.
Figure 2:
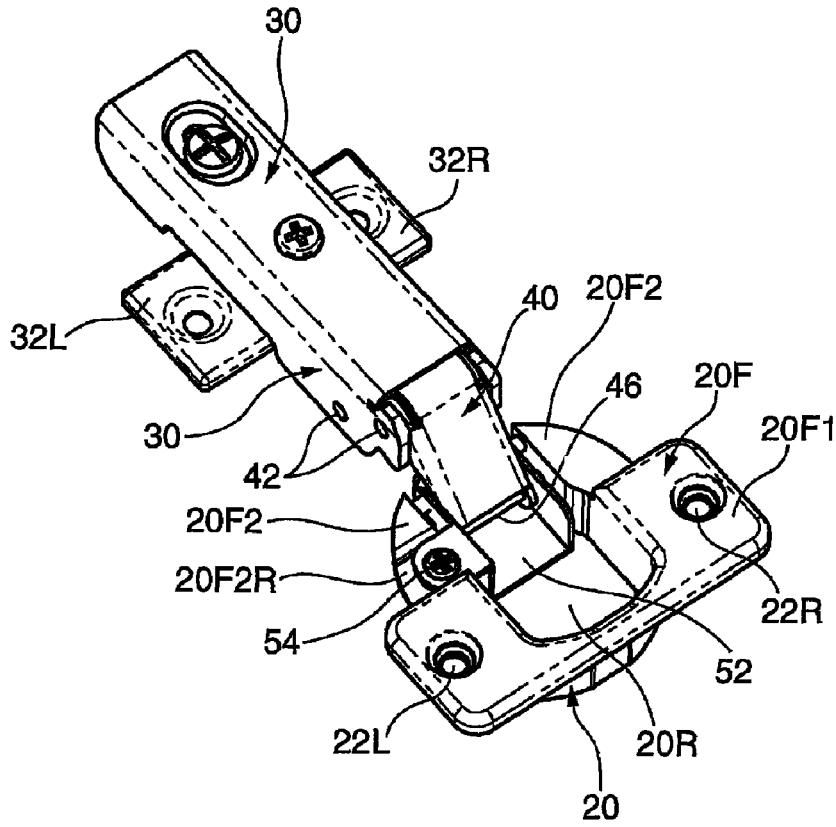
FIG. 2 is a perspective view of the cup embedded type hinge device with position adjustment function of FIG. 1 and seen from an upper side of a cup member.
Figure 3:
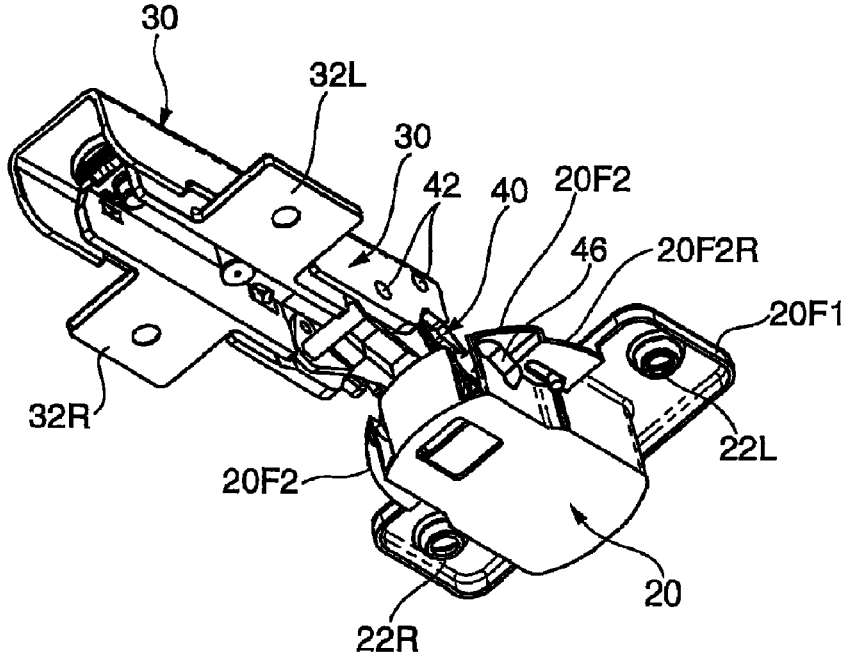
FIG. 3 is a perspective view of the cup embedded type hinge device with position adjustment function of FIG. 1 and seen from a lower side thereof.
Figure 4:
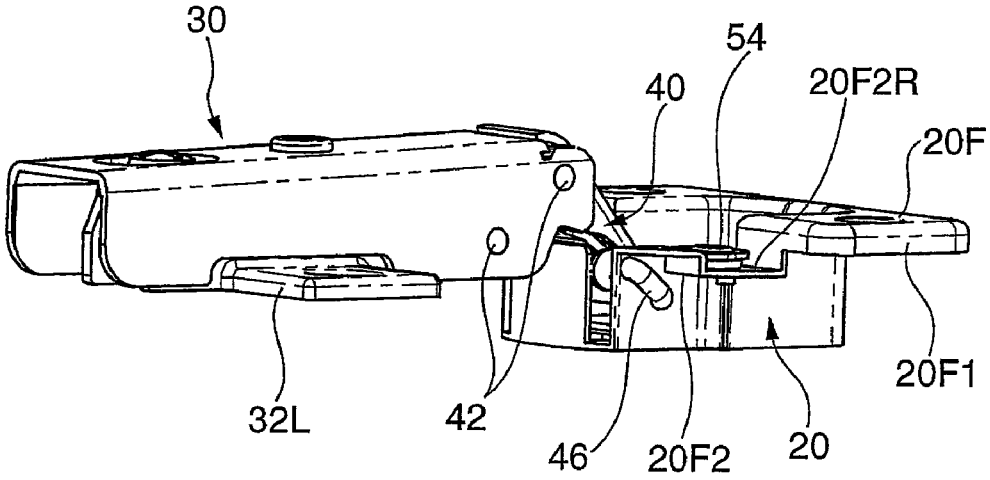
FIG. 4 is a perspective view of the cup embedded type hinge device with position adjustment function of FIG. 1 and seen from the side thereof.
Figure 5:
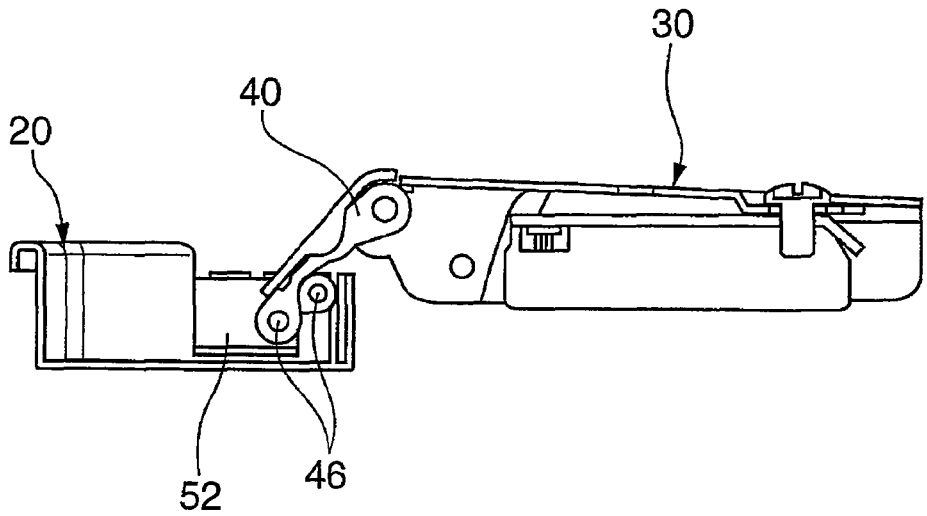
Figure 5:
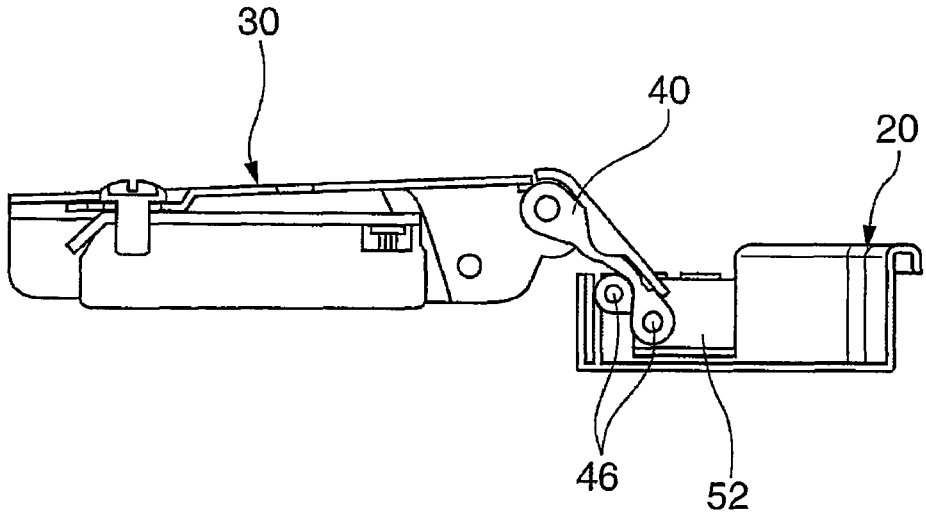
Figure 6:
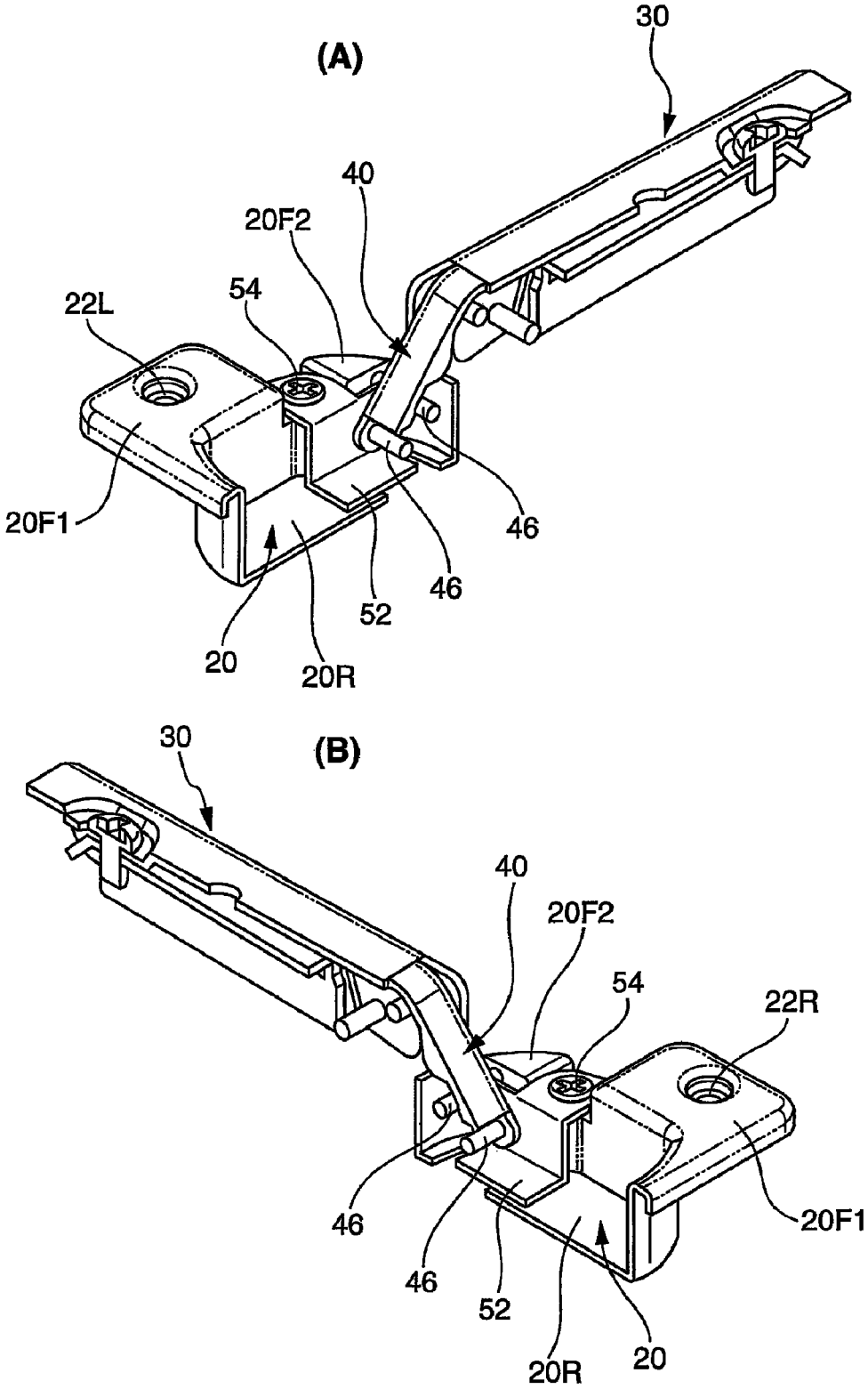
Figure 7:
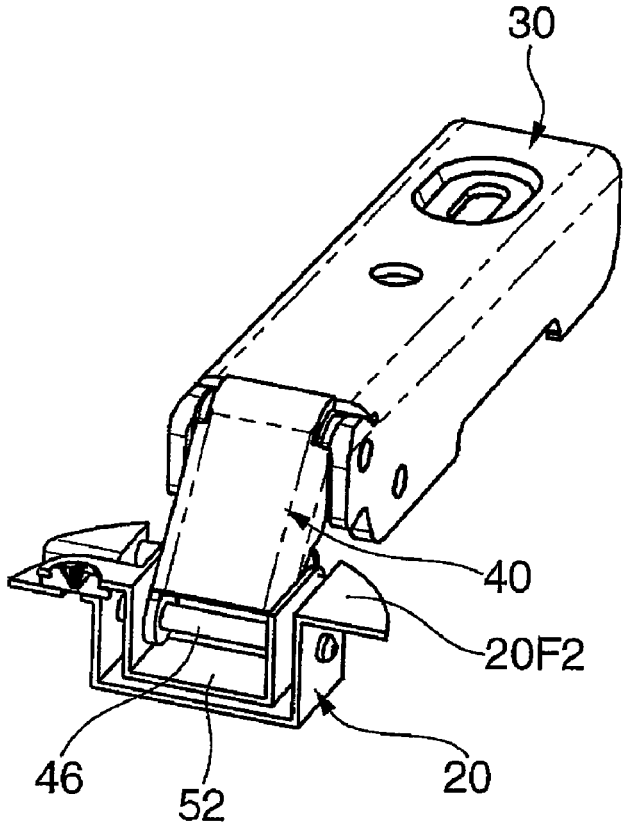
FIG. 7 is a perspective view of the position adjustment mechanism of the cup embedded type hinge device with position adjustment function of FIG. 1 with the cup member omitted.
Figure 8:
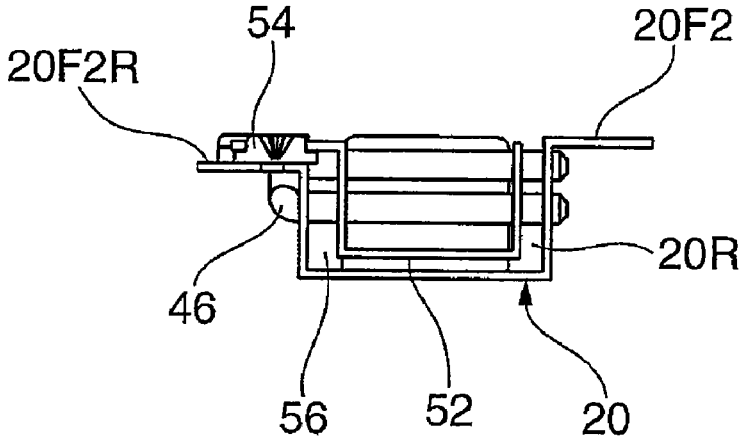
FIG. 8 is a front view of the position adjustment mechanism of FIG. 5.

Explaining a form of first embodiment of the invention with reference to FIGS. 1 through 9 in details, the exploded state of the whole cup embedded type hinge device 10 with position adjustment function according to the form of first embodiment is shown in FIG. 1 while an assembly state with a hinge body partially illustrated is shown in FIGS. 2 through 6.

The cup embedded type hinge device 10 with position adjustment function according to the form of first embodiment of the invention comprises a cup member 20 to be attached in a state where it is embedded in an inner wall of one of two objects to be connected to each other in an openable/closable manner, a movable object (a door), one of stationary object (a case) and a movable object (a door) of a cabinet, for example, a hinge body 30 rotatably attached to the cup member 20 through an arm member 40 to be attached to the other object (the case). The cup embedded type hinge device 10 with position adjustment function also comprises a position adjustment mechanism 50 provided between the arm member 40 and the cup member 20 so that the position of the cup member 20 can be adjusted relative to the hinge body 30.

As shown in FIGS. 1 through 6, the cup member 20 has a cup body 20B in the form of approximately rectangular cup-shape embedded in the inner wall of the movable object (door) and has a flange 20F to be secured to the inner wall surface of the movable object (door) around the cup body 20B. As shown in FIGS. 1 through 6, the flange 20F includes a first flange half 20F1 having a high upper face and a second flange half 20F2 having a low upper face surface. The second flange half 20F2 further has a recess 20F2R, an upper surface of which is lower than the other face of the second flange half 20F2 on the side of the first flange half 20F1. In these figures, a numeral 20R indicates a recess of the cup member 20 and numerals 22R and 22L indicate two screw penetration holes formed in the first flange half 20F1 and through which penetrate screws for attaching the cup member 20 to the movable object (the door).

In the illustrated form, the hinge body 30 has the longitudinal form of cross section of reverse U-shape as shown in FIG. 1 and also has a pair of flanges 30FR and 30FL provided on the middle of both side walls and to be secured to the inner wall of the stationary object (the case). The flanges are secured to the hinge body 30 in a removable or integral manner. In these figures, numerals 32R and 32L indicate two screw penetration holes formed in the pair of flanges 30FL and 30RF and through which penetrate screws for attaching the hinge body 30 to the stationary object (the case).

The arm member 40 comprises two link arms, each one end of which is pivotally supported on the end of the hinge body 30 on the side of the cup member 20 by pivotal pins 42 and each other end of which is pivotally supported on the cup member 20 by a pivotal pin 46 of two integral pin portions penetrating through two pairs of pin penetration holes 44 formed in two link arms of the arm member 40 (only one pin penetration hole of one of the link arm shown in the figure), front and back pairs of pin penetration holes 52H in a position adjustment holder 52 of a position adjustment mechanism 50 described later in details and front and back two pin penetration holes 24 formed in the side walls of the cup member 20.

Figure 22:
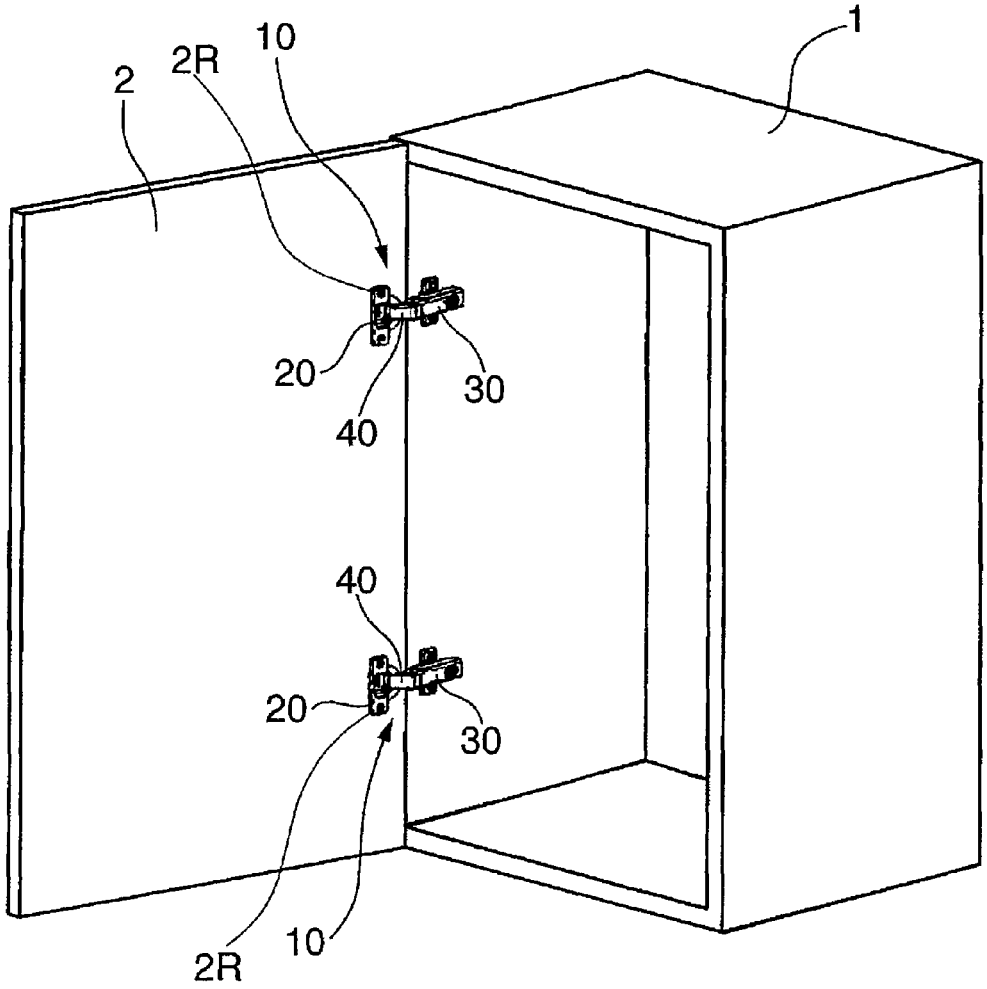
FIG. 22 is a perspective view of a state of use of the hinge device shown in FIG. 1 through FIG. 9.

As shown in FIGS. 2 through 6, this hinge device has the state where the cup member 20, the arm member 40 and the hinge body 30 are developed as shown in FIGS. 2 through 6 in the case where the movable object (the door) of the cabinet is opened relative to the stationary object (the case) of the cabinet, but the arm member 40 is folded while it is embedded in the recess 20R of the cup member 20 in the case where the movable object (the door) of the cabinet is closed relative to the stationary object (the case) of the cabinet. In FIGS. 2 through 6 is not shown the door closed state. The state of use of the hinge device 10 is shown in FIG. 22, but the hinge device 10 is shown in the state of deployment in this figure.

The position adjustment mechanism 50 comprises an approximately U-shaped position adjustment holder 52 superposed on the recess 20R of the cup member 20 so that the position of the position adjustment holder 52 can be adjusted within the recess 20R through a gap 56 (see FIG. 8) and a cam member 54 provided between the approximately U-shaped position adjustment holder 52 and the cup member 20 to change the position of the cup member 20 relative to the position adjustment holder 52.

The position adjustment mechanism 50 of the hinge device 10 according to the form of first embodiment of the invention has the single U-shaped position adjustment holder 52 and the single cam member 54 as shown in FIG. 1. The position adjustment mechanism 50 has a mount piece 52M provided on this single U-shaped position adjustment holder 52, engaged into a second recess 20F2R of the flange half 20F2 of the cup member 20 and slidably superposed on the second recess 20F2R corresponding to the flange half 20F2. The cam member 54 is disposed between the second flange half 20F2 and the mount piece 52M of the single U-shaped position adjustment holder 52.

Figure 9:
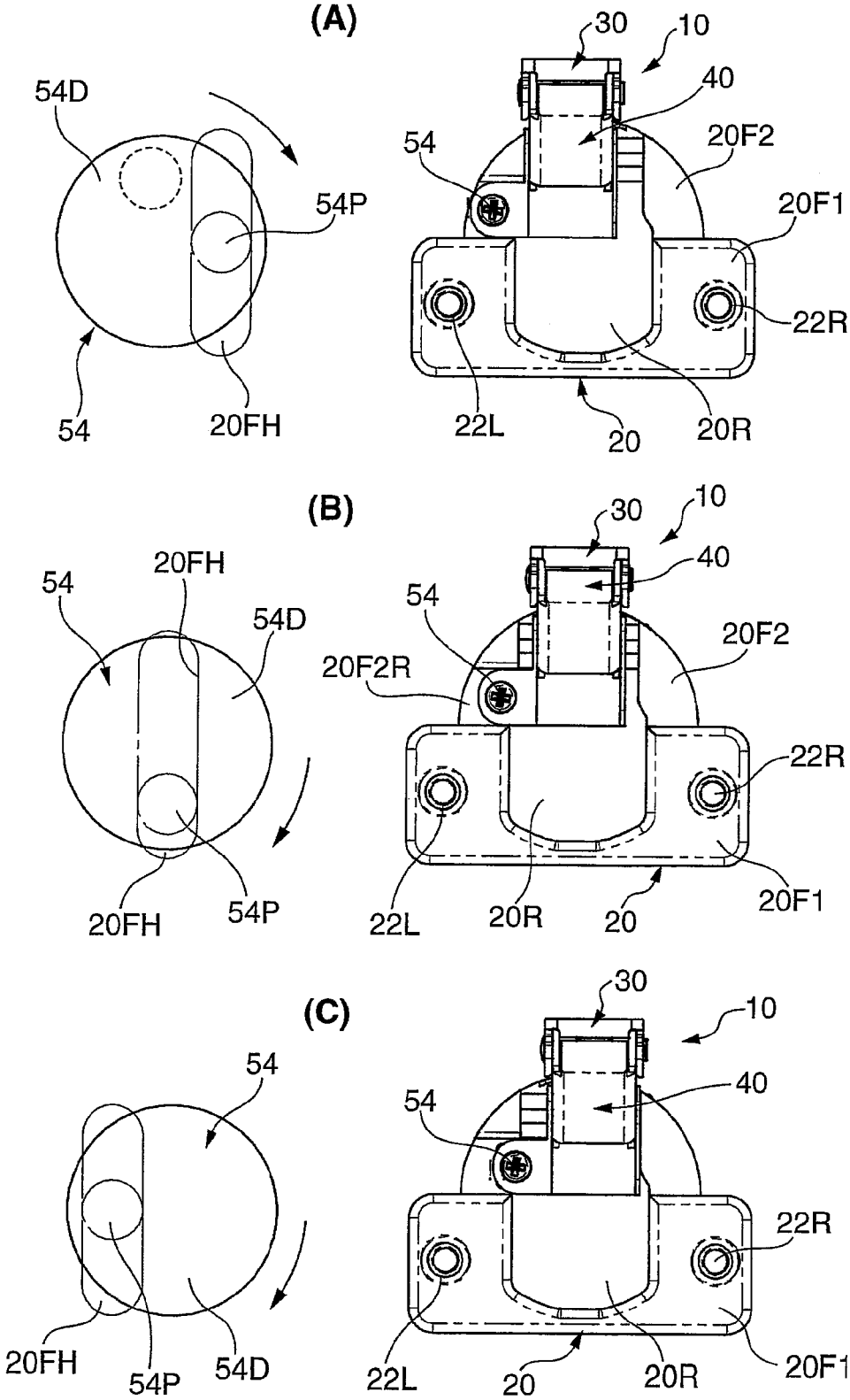
Figure 20:
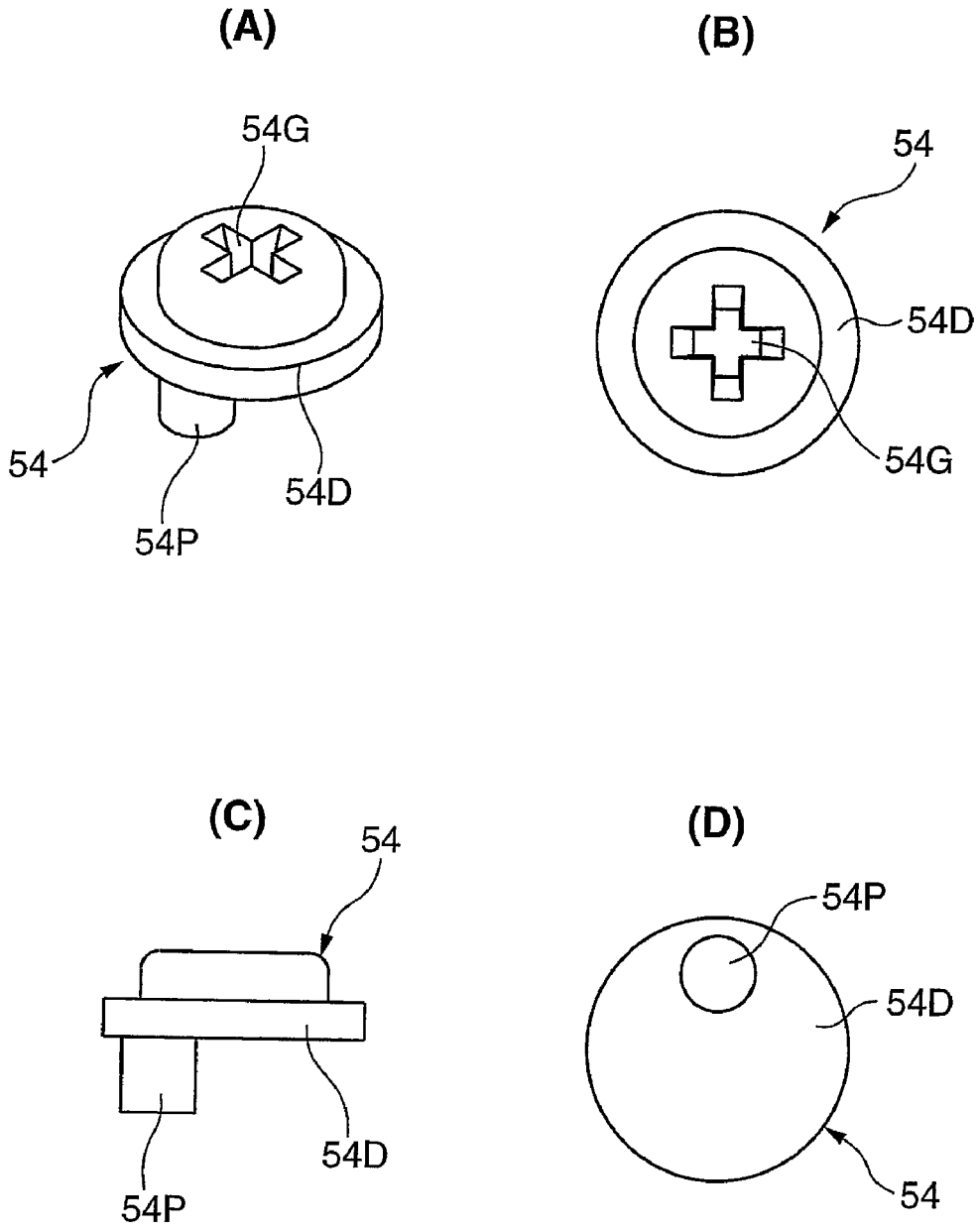

As shown in FIG. 1 and in an left-hand enlarged portion of FIG. 9 and as shown in FIG. 20 in a more enlarged manner, the cam member 54 comprises a cam disk 54D rotatably engaged into a circular hole 52MH formed in the mount piece 52M of the U-shaped position adjustment holder 52 and an eccentric pin 54P engaged into an elongated hole 20FH formed in the recess 20F2R of the flange half 20F2 of the cup member 20 (an elongated hole formed in a direction forward or backward relative to the hinge body 30). The cam disk 54D has a cross type groove 54G where a cross type screw driver for rotating the cam member 54 is engaged.

Next, an operation of attachment as well as a position adjustment of the cup embedded type hinge device 10 with position adjustment function according to the form of first embodiment of the invention will be explained with reference to FIG. 9.

Firstly, the hinge body 30 of the hinge device 10 is attached to the inner wall surface of the stationary object (the case) of the cabinet that is a container while the cup member 20 is attached to the inner wall surface of the movable object (the door) of the cabinet. Screws penetrate through the screw penetration holes 32R and 32L of the hinge body 30 while other screws penetrate through the screw penetration holes 22R and 22L of the cup member 20 and these screws are threadedly engaged with the inner wall surface of the stationary object (the case) and the inner wall surface of the movable object (the door), respectively whereby the hinge body 30 and the cup member 20 are attached to the inner wall surface of the stationary object (the case) and the inner wall surface of the movable object (the door), respectively. FIG. 22 shows the state where the hinge device 10 is used. In the form of FIG. 22, the hinge device 10 is used for attaching the laterally opened type door 2 to one of vertical edges of the case 1 in an openable/closable manner. Although not clear in FIG. 22, the cup member 20 of the hinge device 10 is engaged into a hollow 2R of approximately circular form provided in the inner face of the door 2 so that the first flange half 20F1 engages the inner face of the door 2 and the second flange half F2 enters the hollow 2R.

Thereafter, a cross type screw driver is engaged into the cross type groove 54G of the cam member 54 and the cam member 54 is rotated by the screw driver in a clockwise or counterclockwise direction whereby the cup member 20 moves in a rightward or leftward direction relative to the position adjustment holder 52 so that the position of the cup member 20 is set up.

More particularly, as the eccentric pin 54P of the cam member 54 rotates in a clockwise direction from the position indicated by a dotted line of FIG. 9 (A), the cup member 20 is relatively displaced on the basis of the center position of the cam member 54 in a rightward direction as viewed in FIG. 9 (in a downward direction in the attachment position of FIG. 22) while the eccentric pin 54P moves upwardly toward the middle position within the elongated hole 20FH in the second flange half 20F2 of the cup member 20. Thus, the position of the movable object (the door) attached to the cup member 20 is adjusted in a rightward direction as viewed in FIG. 9 (in a downward direction in the attachment position of FIG. 22) relative to the stationary object (the case) attached to the hinge body 30.

As the cam member 54 further rotates from the position of FIG. 9 (A) in a clockwise direction, the cup member 20 is relatively displaced on the basis of the center position of the cam member 54 in a leftward direction as viewed in FIG. 9 (in an upward direction as viewed in FIG. 22) while the eccentric pin 54P moves downwardly within the elongated hole 20FH in the second flange half 20F2 of the cup member 20. Thus, the position of the movable object (the door) attached to the cup member 20 is adjusted in a leftward direction as viewed in FIG. 9 (in an upward direction as viewed in FIG. 22) relative to the stationary object (the case) attached to the hinge body 30.

As the cam member 54 further rotates from the position of FIG. 9 (B) in a clockwise direction, the cup member 20 is relatively displaced on the basis of the center position of the cam member 54 in a leftward direction as viewed in FIG. 9 (in an upward direction as viewed in FIG. 22) while the eccentric pin 54P moves upwardly toward the middle position of the elongated hole 20FH in the second flange half 20F2 of the cup member 20. Thus, the position of the movable object (the door) attached to the cup member 20 is adjusted further in a leftward direction as viewed in FIG. 9 (in an upward direction as viewed in FIG. 22) relative to the stationary object (the case) attached to the hinge body 30.

In this manner, the cup member 20 is displaced in a rightward or leftward direction relative to the position adjustment holder 52 by rotating the cam member 54 within the circular hole 52MH in the position adjustment holder 52 whereby the position of the movable object (the door) attached to the cup member 20 can be adjusted relative to the stationary object (the case) in a rightward or leftward direction. In FIG. 9, although only three adjustment positions are explained, the position of the movable object (the door) can be set in proper positions, of course. Although not illustrated, after the position of the cup member 20 is adjusted relative to the hinge body 30, the cup member 20 is secured to the position adjustment holder 52 by appropriate means.

Figure 10:
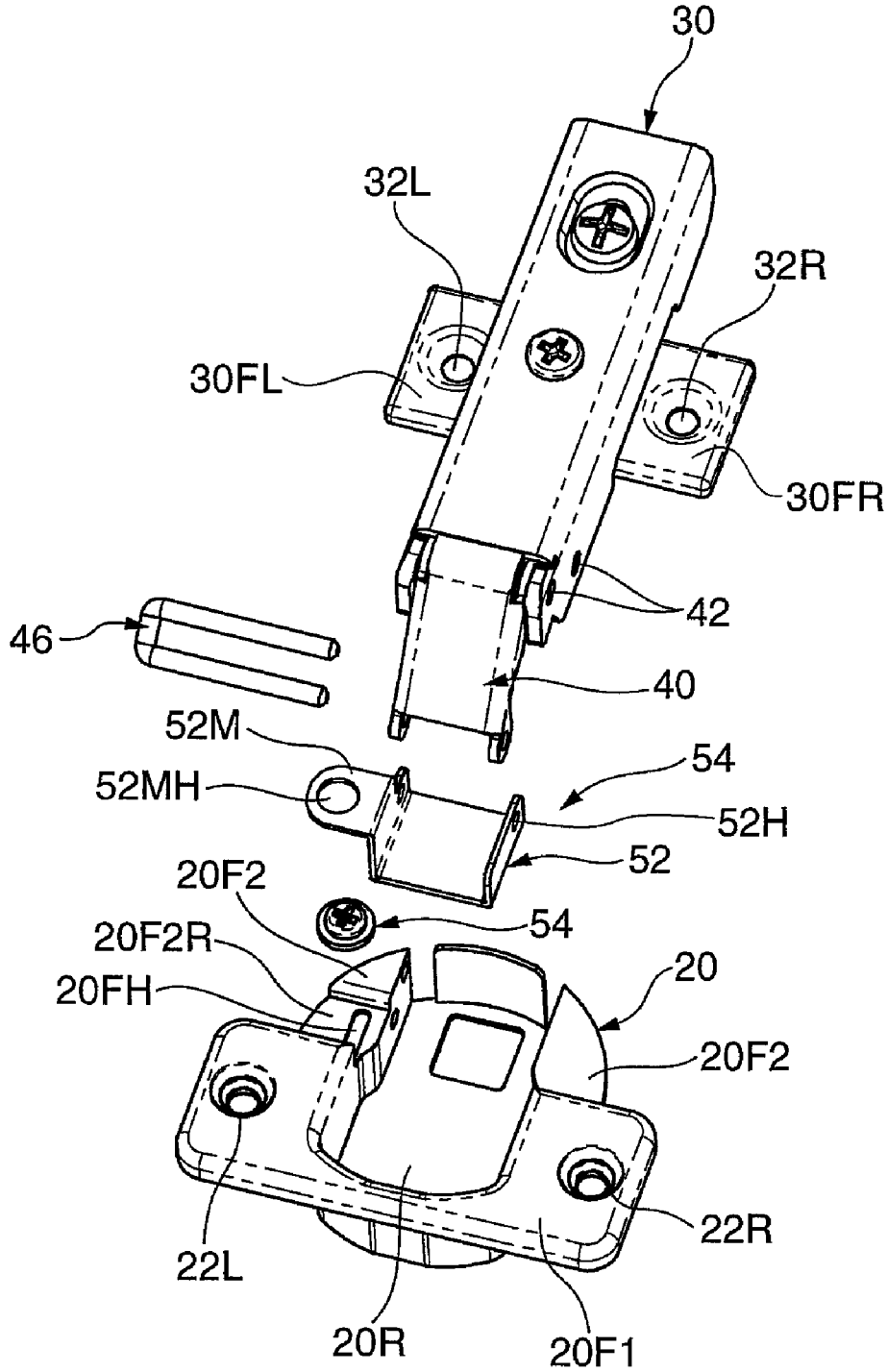
FIG. 10 is an exploded perspective view of the whole of a modification of the cup embedded type hinge device with position adjustment function according to the form of the first embodiment of the invention.

A modification of the cup embedded type hinge device 10 with position adjustment function according to the form of first embodiment of the invention is illustrated in FIG. 10. In this modification, the hinge device is identical to the form of embodiment of FIGS. 1 through 9 except that the position adjustment holder 52 has only one pair of pin penetration holes 52H, but not front and back pairs thereof and that only one of the pin portions of the pivotal pin 42 having two integral pin portions penetrates through the pair of pin penetration holes 52H.

A cup embedded type hinge device 10 with position adjustment function according to a form of second embodiment of the invention is illustrated in FIGS. 11 through 19. Although, in the form of first embodiment, the position of the cup member 20 is adjusted only in the direction leftward or rightward as viewed in the figures, the cup embedded type hinge device 10 with position adjustment function according to the form of second embodiment is different from the cup embedded type hinge device 10 with position adjustment function according to the form of first embodiment at the point where the cup embedded type hinge device 10 with position adjustment function according to the form of second embodiment is provided with the position adjustment mechanism 50 constituted so that the position of the cup member 20 can be adjusted further in the direction forward or backward direction relative to the hinge body 30 in addition to the leftward and rightward direction. This position adjustment mechanism 50 will be explained in detail below.

The position adjustment mechanism 50 of the cup embedded type hinge device 10 with position adjustment function according to the form of second embodiment further comprises a second position adjustment holder 152 provided between the position adjustment holder 52 of the position adjustment mechanism 50 of the hinge device 10 according to the form of first embodiment and the cup member 20 thereof and a second cam member 154 provided between the second position adjustment holder 152 and the second flange half 20F2 of the cup member 20. The other constitution of the cup embedded type hinge device 10 with position adjustment function according to the form of second embodiment of the invention is identical to that of the cup embedded type hinge device 10 with position adjustment function according to the form of first embodiment of the invention.

The second position adjustment holder 152 has a mount piece 152M extending on the side opposite to the mount piece 52M of the first position adjustment holder 52, which is slidably engaged into a recess 20F2R2 provided in the portion on the side opposite to the recess 20F2R of the second flange half 20F2 of the cup member 20.

Figure 11:
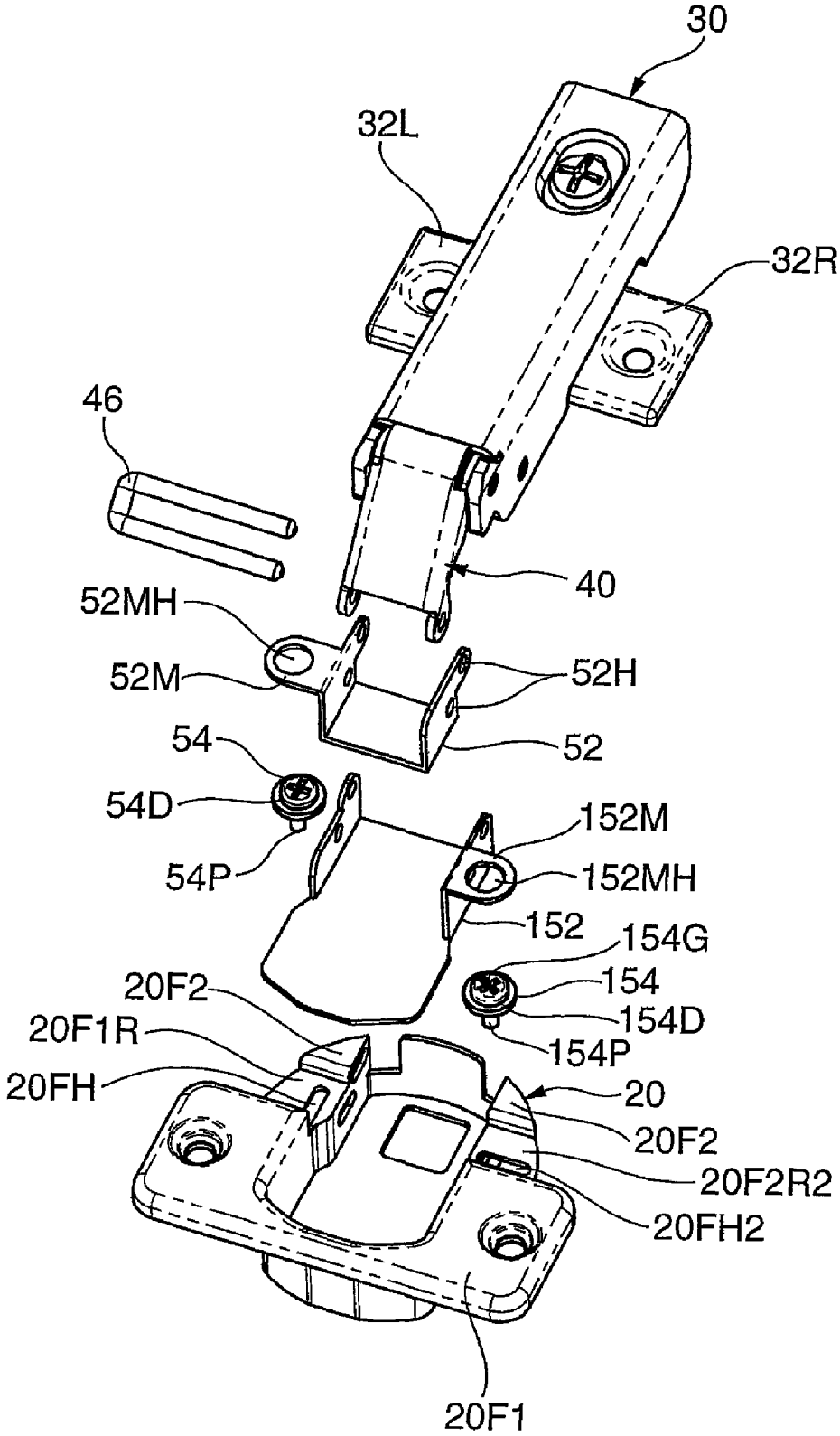
FIG. 11 is an exploded perspective view of the whole of a cup embedded type hinge device with position adjustment function according to a form of a second embodiment of the invention.
Figure 12:
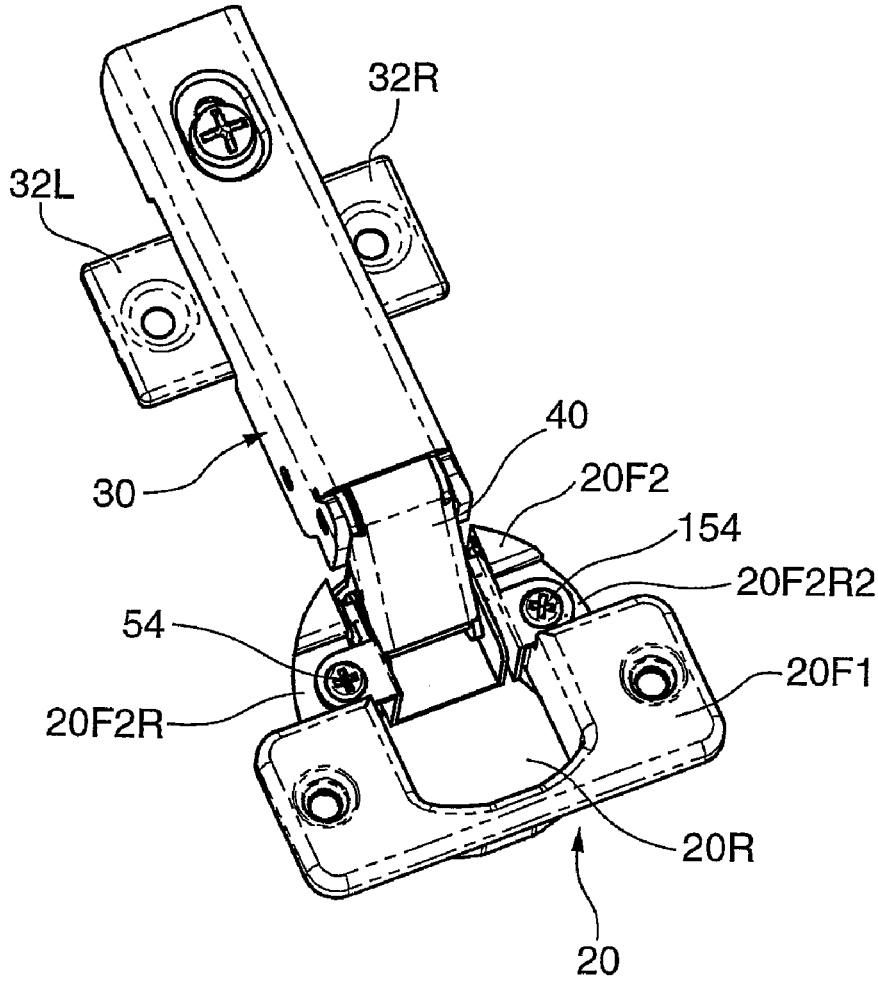
FIG. 12 is a perspective view of the whole cup embedded type hinge device with position adjustment function of FIG. 11 and seen from an upper side of the cup member.
Figure 13:
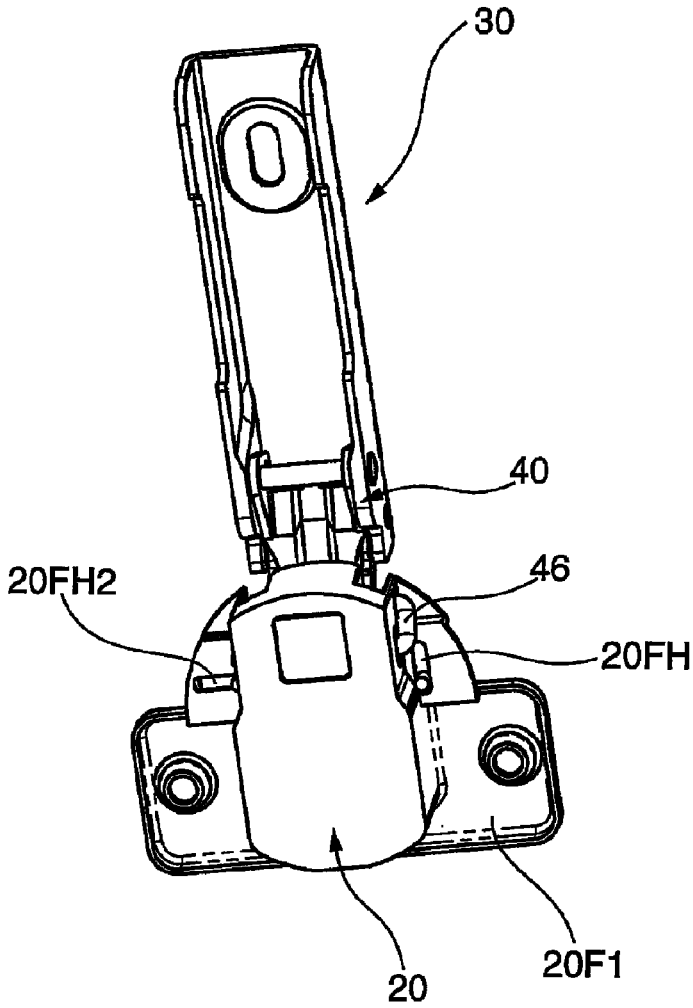
FIG. 13 is a perspective view of the cup embedded type hinge device with position adjustment function of FIG. 11 and seen from a lower side thereof.
Figure 14:
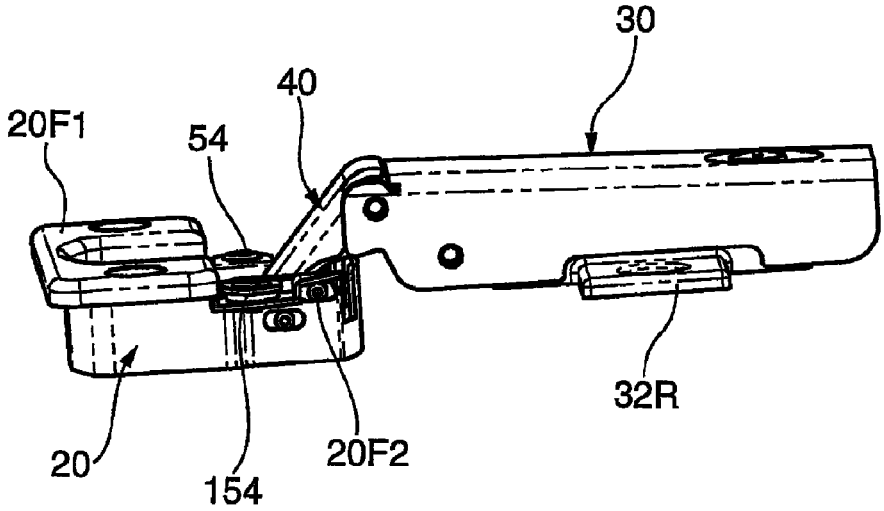
FIG. 14 is a perspective view of the cup embedded type hinge device with position adjustment function of FIG. 11 and seen from the side thereof.
Figure 15:
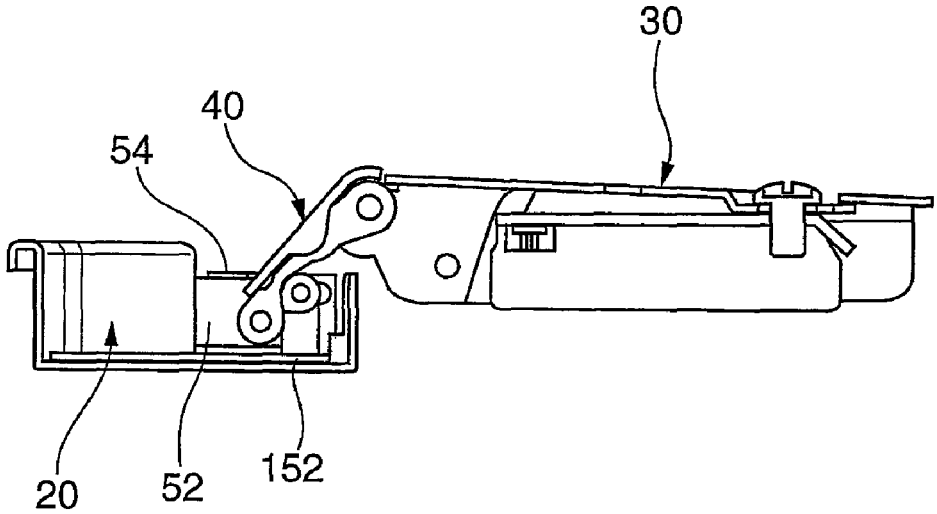
Figure 15:
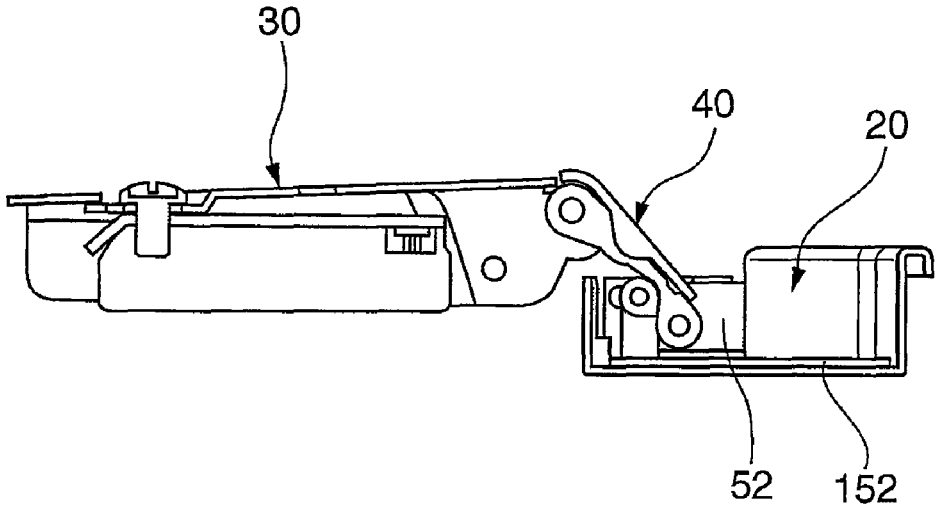
Figure 16:
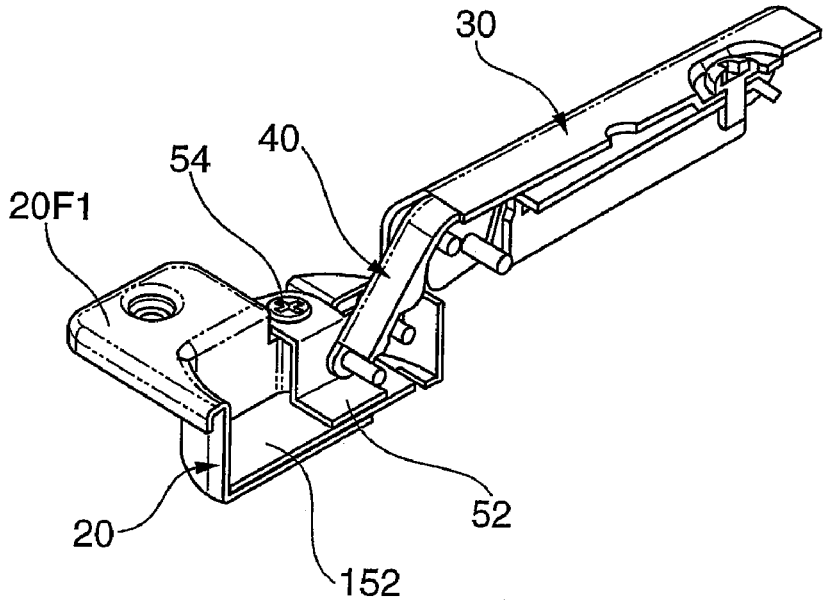
Figure 16:
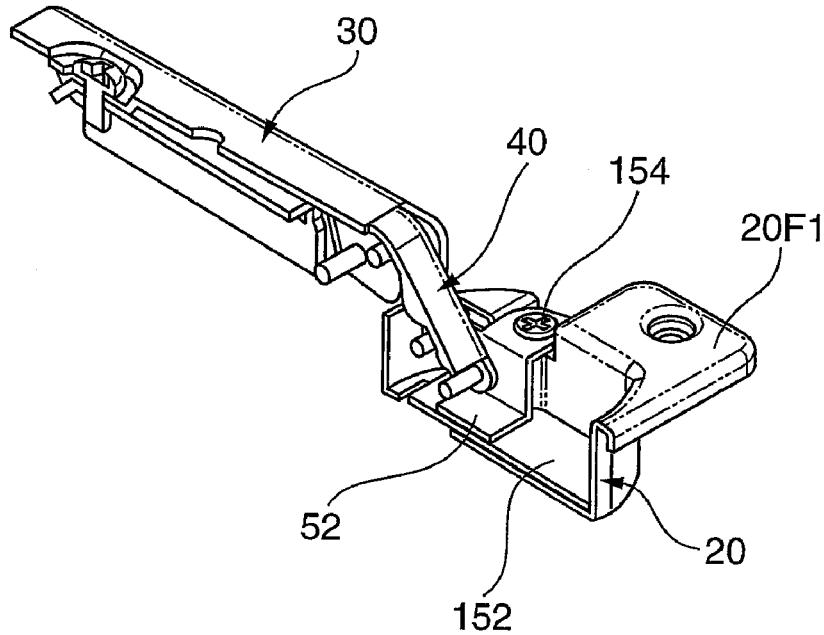
Figure 17:
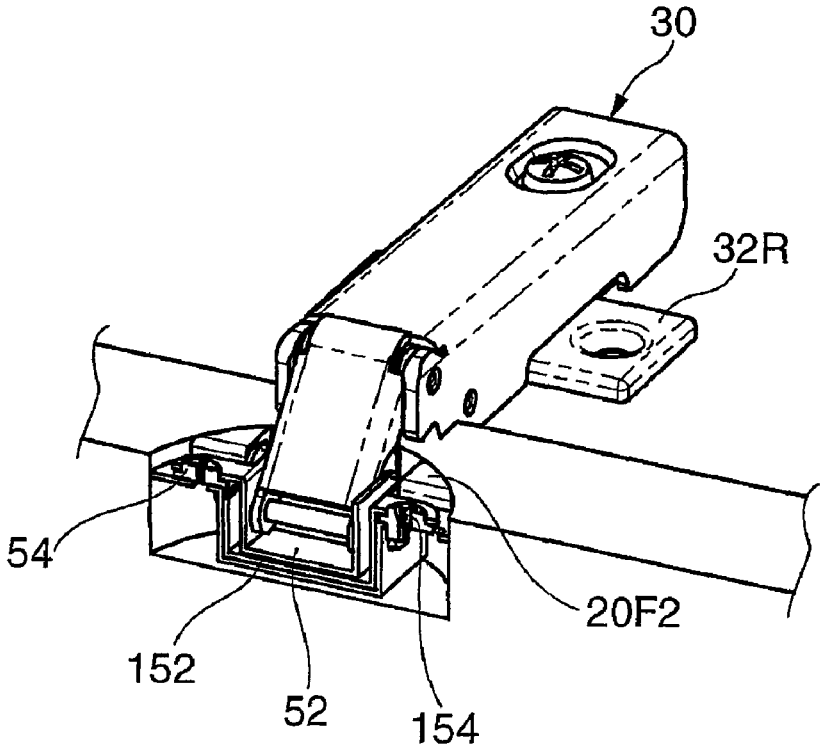
FIG. 17 is a perspective view of the position adjustment mechanism of the cup embedded type hinge device with position adjustment function of FIG. 11 with the cup member omitted.
Figure 18:
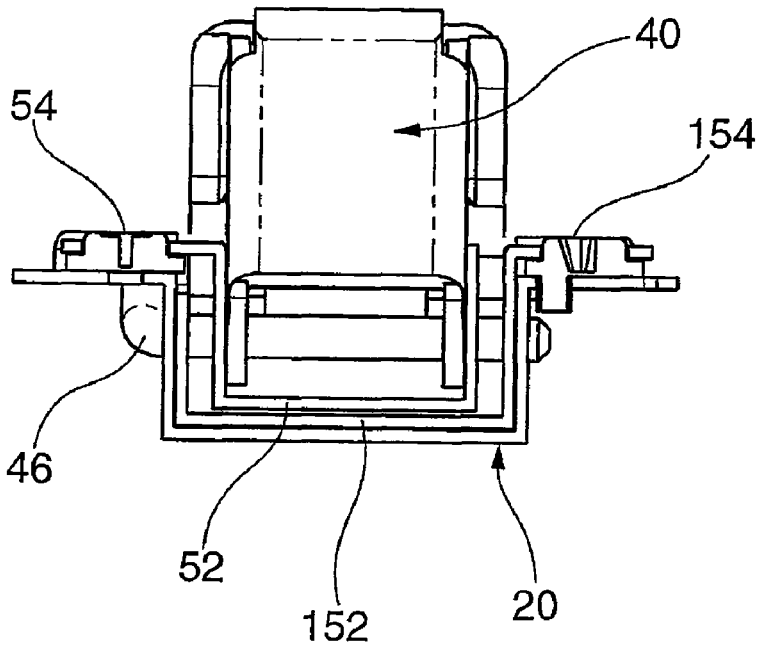
FIG. 18 is a front view of the position adjustment mechanism of FIG. 17.
Figure 19:
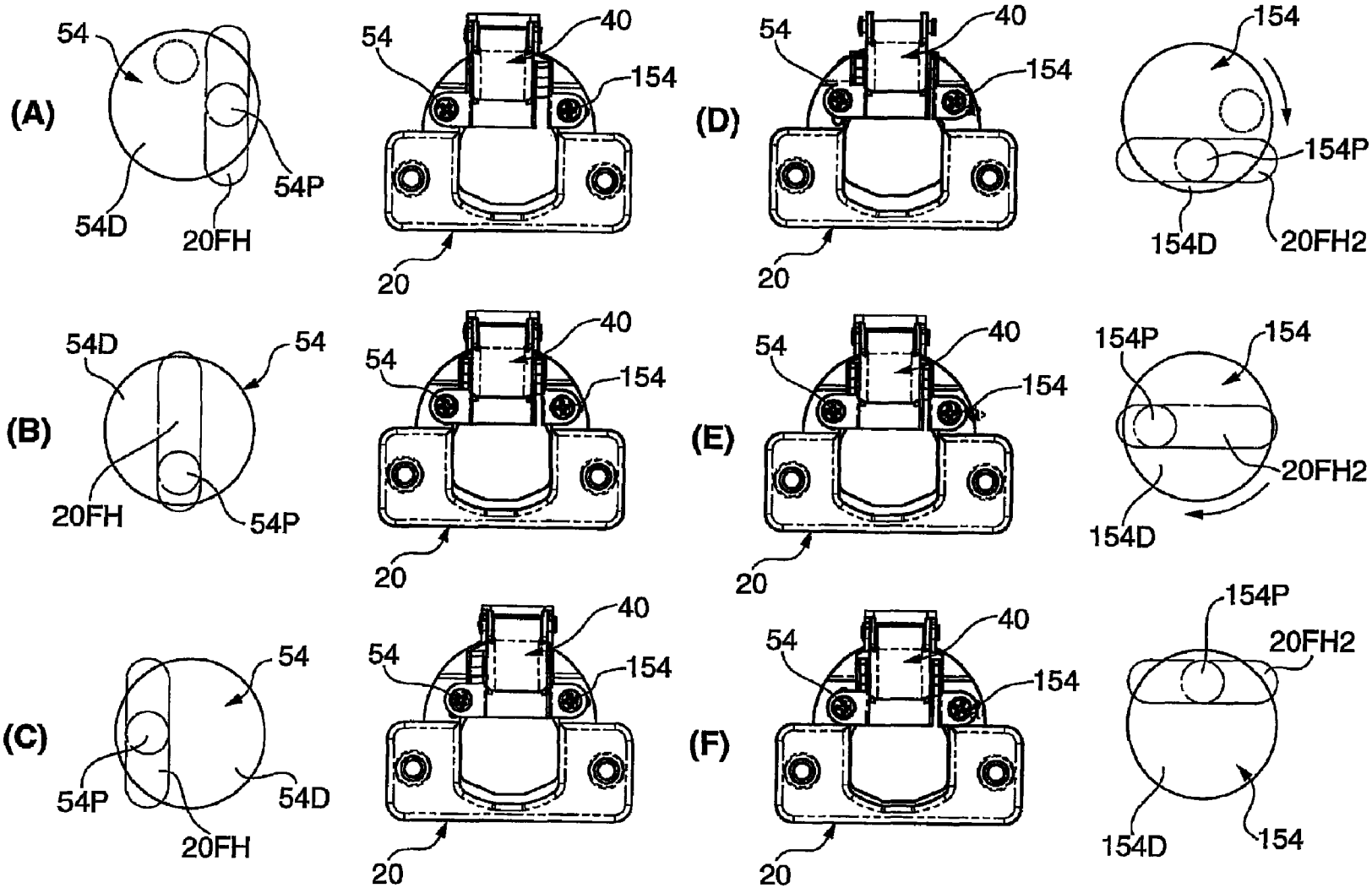

As shown in FIG. 11 and in the left-side enlarged portions of FIG. 19, the second cam member 154 comprises a cam disk 154D rotatably engaged into a circular hole 152MH formed in the mount piece 152M of the U-shaped position adjustment holder 152 and an eccentric pin 154P engaged into an elongated hole 20FH2 formed in the recess 20F2R2 of the flange half 20F2 of the cup member 20 (a laterally elongated hole extended in a leftward and rightward direction). The cam disk 154D has a cross type groove 154G where a cross type screw driver for rotating the cam member 154 is engaged.

Next, an operation of attachment as well as a position adjustment of the cup embedded type hinge device 10 with position adjustment function according to the form of second embodiment of the invention will be explained with reference to FIG. 19.

Similarly to the cup embedded type hinge device 10 with position adjustment function according to the form of first embodiment, the hinge body 30 of the hinge device 10 is attached by screws to the inner wall of the stationary object (the case) of the cabinet, that is the container, while the cup member 20 is attached by screws to the movable object (the door) of the cabinet.

Thereafter, a cross type screw driver is engaged into the cross type groove 54G of the cam member 54 and the cam member 54 is rotated by the screw driver in a clockwise or counterclockwise direction whereby the cup member 20 moves in a leftward or rightward direction relative to the position adjustment holder 52 so that the position of the cup member 20 is set up. Since this adjustment is similar to that of the cup embedded type hinge device 10 with position adjustment function according to the form of first embodiment (see FIGS. 9(A) through 9(C)) as shown in FIGS. 19(A) through 19(C), the detailed explanation will be omitted.

Furthermore, a cross type screw driver is engaged into the cross type groove 154G of the cam member 154 and the cam member 154 is rotated by the screw driver in a clockwise or counterclockwise direction whereby the cup member 20 moves in a forward or backward direction as viewed in FIG. 19 relative to the position adjustment holder 152 so that the position of the cup member 20 is set up.

More particularly, as the eccentric pin 154P of the cam member 154 rotates in a clockwise direction from the position indicated by a dotted line of FIG. 19 (D), the cup member 20 is relatively displaced in a direction far away from the hinge body 30 while the eccentric pin 154P moves toward the middle position within the elongated hole 20FH2 in the second flange half 20F2 of the cup member 20. Thus, the position of the movable object (the door) attached to the cup member 20 is adjusted in a direction far away from the stationary object (the case) attached to the hinge body 30.

As the cam member 154 further rotates from the position of FIG. 19 (D) in a clockwise direction, the cup member 20 is relatively displaced in a direction closer to the hinge body 30 while the eccentric pin 154P moves leftward within the elongated hole 20FH2 in the second flange half 20F2 of the cup member 20. Thus, the position of the movable object (the door) attached to the cup member 20 is adjusted in a direction closer to the stationary object (the case) attached to the hinge body 30, as shown in FIG. 19(E).

As the cam member 154 further rotates from the position of FIG. 19 (E) in a clockwise direction, the cup member 20 is relatively displaced in a direction closer to the hinge body 30 while the eccentric pin 154P moves rightward toward the middle position of the elongated hole 20FH2 in the second flange half 20F2 of the cup member 20. Thus, the position of the movable object (the door) attached to the cup member 20 is adjusted in a direction further closer to the stationary object (the case) attached to the hinge body 30.

In this manner, the cup member 20 is displaced in a forward or backward direction relative to the position adjustment holder 152 by rotating the cam member 154 whereby the position of the movable object (the door) attached to the cup member 20 can be adjusted relative to the stationary object (the case) in a forward or backward direction. In FIG. 19, although three adjustment positions are explained with respect to each of the position adjustment holders 52 and 152 and each of the cam members 54 and 154, the movable object (the door) can be set in proper positions other than three adjustment positions, of course. Similarly, although not illustrated, after the position of the cup member 20 is adjusted relative to the hinge body 30, the cup member 20 is secured to the position adjustment holder 152 by appropriate means.

Figure 21:
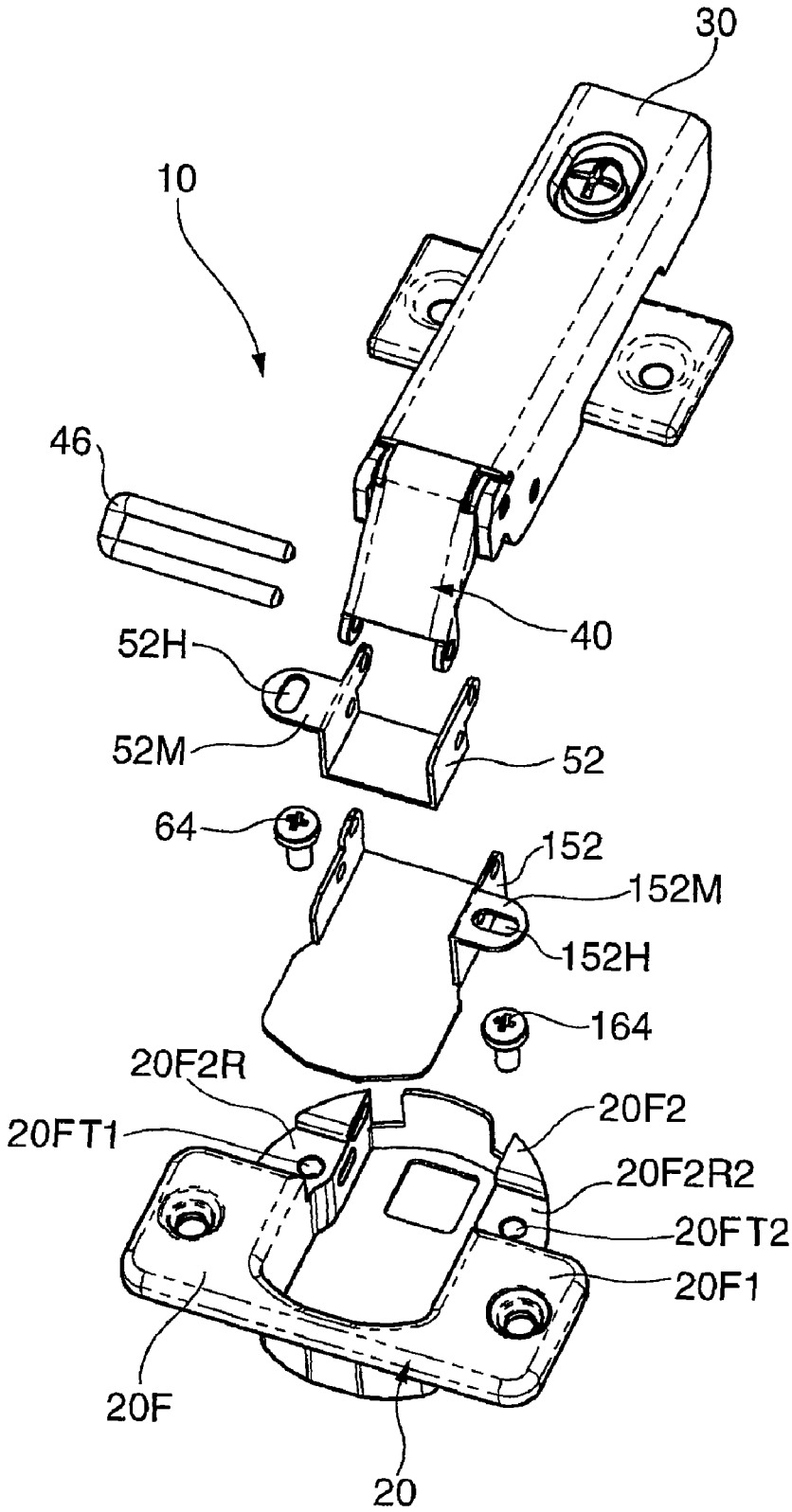
FIG. 21 is an exploded perspective view of the whole cup embedded type hinge device with position adjustment function according to a third embodiment of the invention.

A cup embedded type hinge device 10 with position adjustment function according to the form of third embodiment of the invention is shown in FIG. 21. This form of third embodiment is identical to the form of the second embodiment of FIGS. 11 through 19 except that the position adjustment mechanism 50 is adapted to displace the cup member 20 relative to the arm member 40 and secure the cup member 20 to the arm member 40 without the cam members 54 and 154 without either of the cam members 54 and 154. The same reference numerals designate the same components.

In the form of third embodiment, the cam members 54 and 154 of the second embodiment are replaced by setscrews 64 and 164, respectively. An elongated hole 52H extending in a longitudinal direction of the hinge body 30 is provided in the U-shaped position adjustment holder 52 and an elongated hole 152H extending in a direction widthwise of the U-shaped position adjustment holder 152 is provided in the U-shaped position adjustment holder 152. There are formed threaded holes 20FT and 20FT2 in the second flange halves 20F2 of the cup member 20 on both sides, into which holes are threadedly engaged the setscrews 64 and 164.

In the position adjustment mechanism 50 of the hinge device 10 of the form of the third embodiment, the position adjustment in which the cup member 20 moves in a direction closer to or far away from the hinge body 30 can be accomplished by loosing the setscrew 64 and moving the cup member 20 along the elongated hole 52H in the position adjustment holder 52 in a forward or backward direction and tightening the setscrew 64 in a predetermined position and the position adjustment in which the cup member 20 moves in a widthwise direction relative to the hinge body 30 can be accomplished by loosing the setscrew 164 and moving the cup member 20 along the elongated hole 152H in the position adjustment holder 152 and tightening the setscrew 164 in a predetermined position.

INDUSTRIAL APPLICABILITY

According to the invention, since the cam member of the position adjustment mechanism is disposed not on the bottom of the cup member, but in the position facing the flange of the cup member, the arm member to be folded up in the closed position of the container and embedded in the recess of the cup member never interferes with the components of the position adjustment mechanism and can be positively embedded in the cup member without deepening the recess of the cup member. Accordingly, the design and the assembly of the position adjustment mechanism can be easily carried out, which causes the industrial applicability to be higher.

What is claimed is:

1. A cup imbedded type hinge device with position adjustment function comprising a cup member attached to one of two objects to be connected to each other in an openable/closable manner, an arm member pivotally supported on said cup member by a pivotal support pin; a hinge body pivotally connected to said arm member and attached to the other object; and a position adjustment mechanism for adjusting a position of said cup member relative to said hinge body, said position adjustment mechanism including at least one U-shaped position adjustment holder superposed in a recess of said cup member so as to be able to adjust a position of said U-shaped position adjustment holder within said recess and a cup position setting member to position said U-shaped position adjustment holder and said cup member in a relative position and said pivotal pin extending through said U-shaped position adjustment holder and said cup member whereby said cup member is held on said U-shaped position adjustment holder in a state of setting said cup member position relative to said position adjustment holder by said cup position setting member, said hinge device is characterized in that said position adjustment mechanism includes a cup member flange provided on said cup member to secure said cup member to said one object, a mount piece provided on said U-shaped position adjustment holder that superposes said flange of said cup member and said cup position setting member is cooperating between said flange of said cup member and said mount piece of said position adjustment holder.

2. A cup embedded type hinge device with position adjustment function as set forth in claim 1, and wherein said position adjustment mechanism has only one U-shaped position adjustment holder whereby the position of said cup member is adjustable either longitudinally or transversely relative to said hinge body.

3. A cup embedded type hinge device with position adjustment function as set forth in claim 1, and wherein said position adjustment mechanism has two said U-shaped position adjustment holders and two said cup position setting members, whereby the position of said cup member is adjustable relative to said hinge body both longitudinally and transversely, one U-shaped position adjustment holder providing longitudinal adjustment and the other U-shaped position adjustment holder providing transverse adjustment.

4. A cup embedded type hinge device with position adjustment function as set forth in claim 1 and wherein said cup position setting member is provided with a cam member having a cam disk and an eccentric pin, said cam disk being rotatably engaged in a circular hole formed in said mount piece of said U-shaped position adjustment holder and said eccentric pin of said cam member being engaged in an elongated hole in said flange of said cup member whereby said cup member is adjustably positioned relative to said position adjustment holder.

5. A cup embedded type hinge device with position adjustment function as set forth in claim 1, and wherein said cup position setting member comprises a threaded hole formed in said flange of said cup member, an elongated hole formed in said mount piece of said position adjustment holder and a setscrew threadedly engaged into said threaded hole in said flange of said cup member through said elongated hole in said mount piece.

* * * * *